US005239783A

United States Patent [19]

Matechuk

[11] Patent Number: 5,239,783

[45] Date of Patent: Aug. 31, 1993

[54] DRYWALL SANDER

[76] Inventor: William Matechuk, Apartment 314, 20 Bradman Avenue, St. Catharines, Ontario, Canada, L2M 3S5

[21] Appl. No.: 901,694

[22] Filed: Jun. 22, 1992

Related U.S. Application Data

[63] Continuation-in-part of Ser. No. 747,605, Aug. 20, 1991, abandoned.

[51] Int. Cl.[5] ..... B24B 23/00; B24B 55/06

[52] U.S. Cl. ..... 51/180; 51/170 T; 51/273

[58] Field of Search ..... 51/170 R, 170 T, 273, 51/170 PT, 170 MT, 170 TL

[56] References Cited

U.S. PATENT DOCUMENTS

| | | | |
|---|---|---|---|
| 1,700,331 | 1/1929 | Perks | 51/168 |
| 4,124,956 | 11/1978 | Levinson | 51/273 |
| 4,590,713 | 5/1986 | Yasui | 51/170 MT |
| 4,782,632 | 11/1988 | Matechuk | 51/180 |

*Primary Examiner*—Roscoe V. Parker

*Attorney, Agent, or Firm*—McConnell and Fox

[57] ABSTRACT

A motorized rotary sander is provided with an efficient dust pick-up system which particularly adapts it to drywall sanding. The abrasive discs used in the system are designed to provide an improved finish on drywall and similar surfaces. The discs are quickly and easily replaced by virtue of the bayonet type fastening system. The combination results in a highly efficient drywall sanding device which requires minimum skill on the part of the user and can produce superior results.

14 Claims, 3 Drawing Sheets

DRYWALL SANDER

This application is a continuation-in-part of application 07/747,605 filed Aug. 20, 1991, and now abandoned.

FIELD OF THE INVENTION

This invention relates to motorized sanders and in particular to rotary power driven sanders.

DESCRIPTION OF THE PRIOR ART

In drywall construction it is necessary, after taping and filling the joints between the panels, to sand the joint to reduce it to the same level as the adjacent panels and thus obscure any evidence of a joint.

In the past this had been done with manual sanders consisting simply of a supporting block and a section of abrasive material on the block. An improved power operated sander was disclosed and claimed in U.S. Pat. No.4,782,632 issued Jul. 11, 1988.

While the sander disclosed in that patent has proved useful, there are certain improvements which we have since evolved which improve its operation and convenience. In particular, the presence of the vacuum hose makes the apparatus disclosed in that patent somewhat clumsy. Replacement of the sanding surface was not discussed but required the operator to remove a retaining bolt which held the sanding disc in place. This obviously caused some delays in operating the sander.

Extraction of the dust during operation of the sander is of great importance and design of the areas through which the dust passes determines the continuing effectiveness of the extraction system as does also the selection of the vacuum system.

There are also certain peculiarities to the sanding of drywall which may not be of the same importance in other sanding applications. The material used to cover the tape and fill the joint is easily abraded and care must be taken to avoid scoring the surface. The paper surface of the plaster board is also easily damaged when sanding. Selection of suitable characteristics of the abrasive material becomes of great importance.

The amount of force applied to the surface by the rotating disc of the sander and concentration of force on particular areas also affects the final result.

SUMMARY OF THE INVENTION

In accordance with the present invention the vacuum line is incorporated into the handle of the sander thus eliminating the loose vacuum line adjacent the head. The shroud surrounding the sanding disc is contoured to provide a smooth substantially constant crossectioned duct for air flow from the head into the handle and out to the vacuum system which is selected to handle the large quantities of dust produced during the sanding of drywall.

The abrasive disc used for sanding is specially designed in view of the nature of the surface being sanded. In the case of drywall the abrasive disc has a foam backing and is faced with a grit of suitable size. Preferably the grit is coated directly on the foam but in any case the disc must retain its flexibility. The foam is selected to have a non-linear compression characteristic so that when compressed, the force required to produce a given deflection increases as the foam is compressed. The foam also has what may be termed a quick memory, that is, when compressed and released the foam quickly recovers its original thickness.

The diameter of the abrasive disc and its associated drive plate is selected to operate over as large an area as possible while recognizing the limitations of motor horsepower and weight in a hand tool and the hazard of excessive peripheral velocity. Suitable diameters may be 6 to 10 inches.

Finally, to increase efficiency the disc is held on the drive plate by a quick release high compression locking device which permits rapid and positive replacement of worn abrasive discs.

A clearer understanding of our invention may be had from a consideration of the following description and drawings in which:

DESCRIPTION OF THE PREFERRED EMBODIMENT

Figure 1:
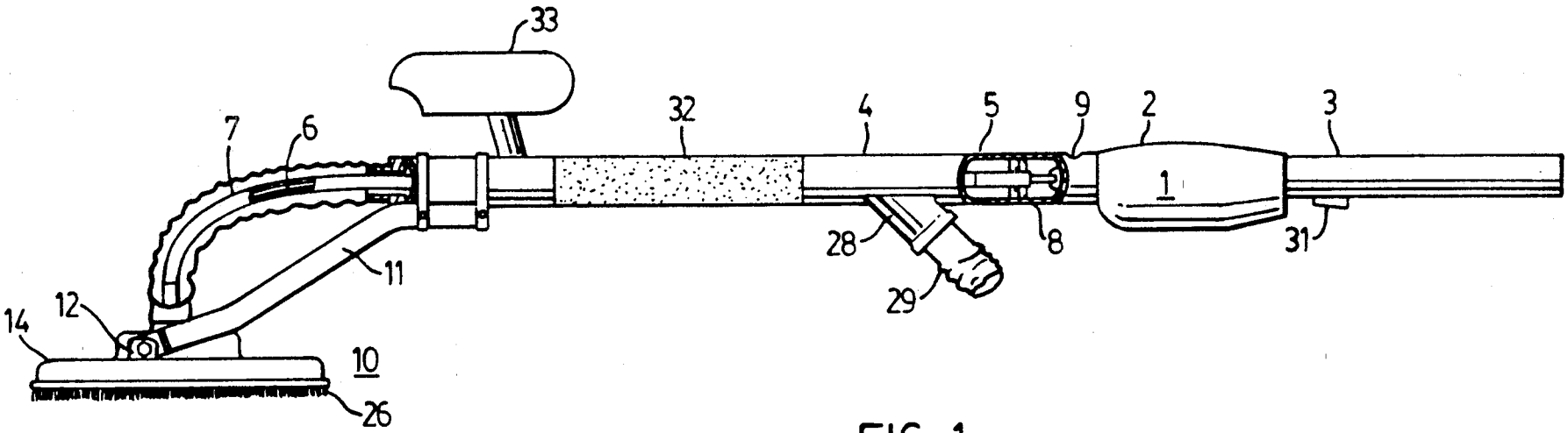
FIG. 1 is a view, partially in section, of a sander in accordance with the invention.

Considering first FIG. 1, it will be seen that a motor 1, having a housing 2 and a rear extension 3 behind the motor, is connected to a wand 4. The shaft of the motor is connected to a flexible drive 5 comprising a flexible drive shaft 6 supported by bearings within a flexible sheath 7 which passes through a seal 8 within wand 4 which separates the junction of the motor shaft and the flexible drive from the interior of the wand 4. A hole 9 on the motor side of seal 8 allows the flexible drive to be at atmospheric pressure.

Sanding head 10 is mounted on a bracket 11 which consists of a pair of arms extending from wand 4. The ends of the arms are pivotally connected to a pair of legs 12 which extend from plate 13. A shroud, preferably formed from transparent plastic, encloses the drive plate 15 and abrasive disc 18.

Figures 2, 4:
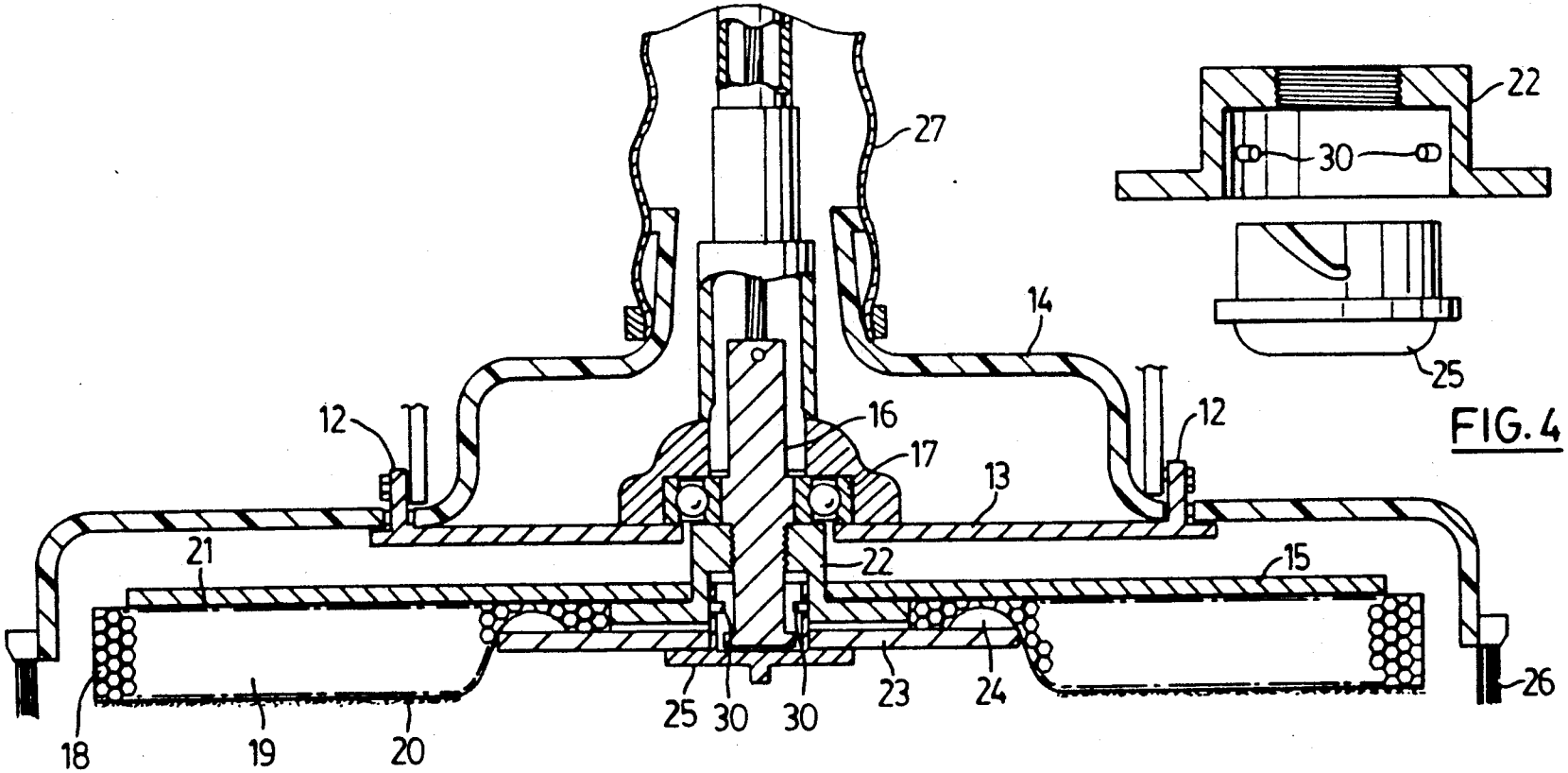
FIG. 2 is a sectional view of the sanding head 10 of FIG. 1 on section line II—II of FIG. 3.
FIG. 4 is an enlarged view of the locking device used to retain the abrasive disc.
Figure 3:
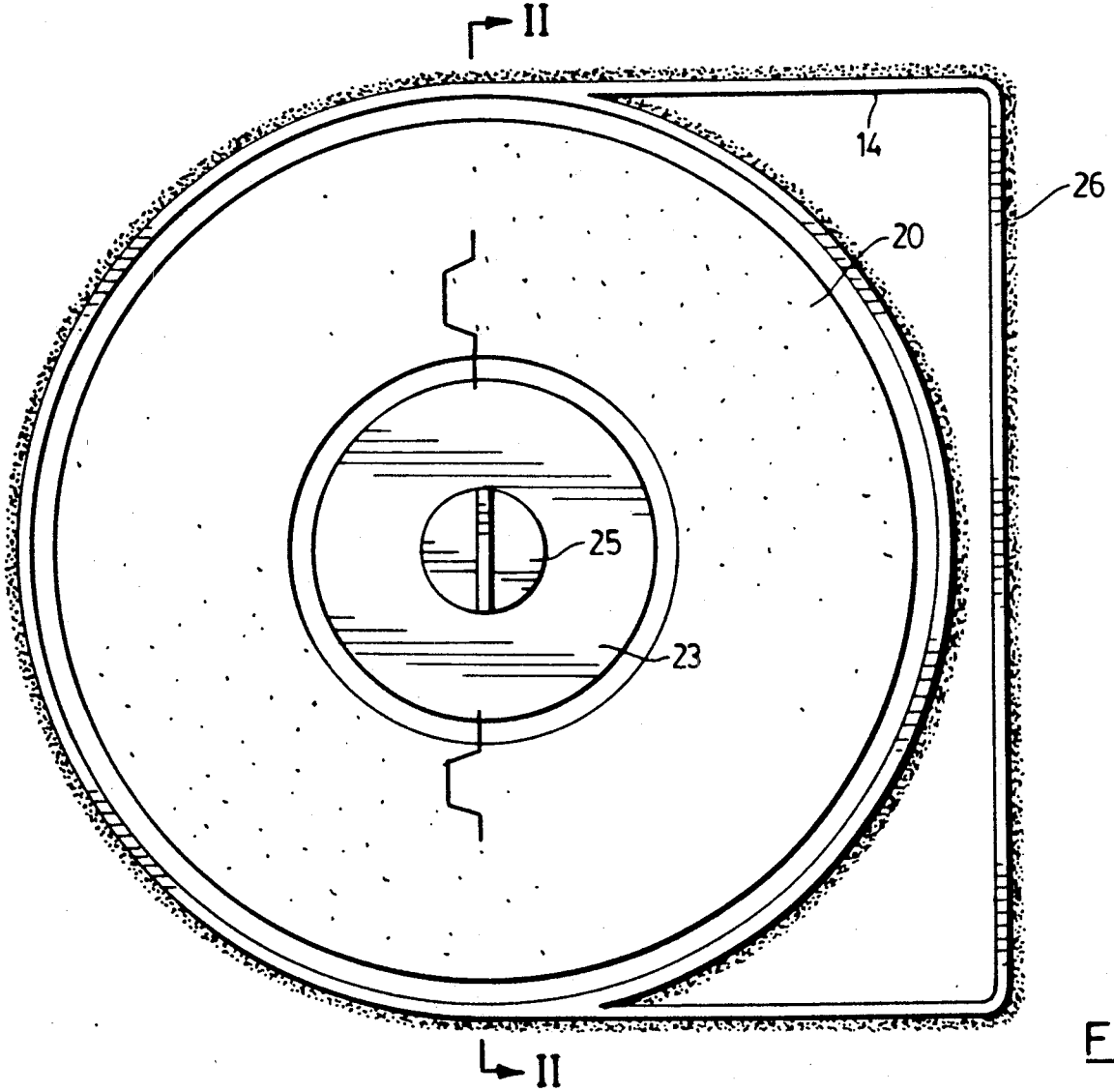
FIG. 3 is a plan view of the bottom of the sanding head 10 of FIG. 1.

As shown in FIG. 2, the drive plate 15 is mounted on a shaft 16 supported in bearing 17 which in turn is mounted on plate 13. Shaft 16 is connected to flexible drive shaft 6.

Abrasive disc 18 comprise an annulus of open-celled foam 19 coated on its surface with a suitable abrasive 20. The abrasive 20 is fastened to the foam 19 by means of a soft flexible adhesive which ensures that the whole disc remains flexible. The surface of drive plate 15 is provided with a frictional drive surface 21 for engaging the foam 19. This drive surface may consist of a coarse abrasive or some other surface treatment capable of engaging the open cells of foam 19 in such a manner as to reliably drive the abrasive disc 18. A typical alternative treatment would be a portion of hook material such as is used in hook and loop fasteners sold under the trademark VELCRO.

The drive plate 15 is mounted on a hub 22 which in turn is mounted on shaft 16. The abrasive disc 18 is held down on drive plate 15 by retainer disc 23 which includes a plurality of protuberances 24 which cause localized compression of the foam 19. The retainer disc 23 is held in place by a twist lock bayonet type fastener 25 shown in more detail in FIG. 4.

The periphery of shroud 14 includes a resilient material but as shown, unlike the sander of U.S. Pat. No. 4,782,632 , the resilient material is made up of bristles 26 which not only provide a resilient partial air seal but also scrub the surface to assist in dislodging the dust.

Vacuum line 27 is connected to the shroud 14 and an air passage is therefore provided from the periphery of the shroud, around the abrasive disc, between the plate 13 and the shroud 14, past bearing 17 and into vacuum line 27 through wand 4 and out through stub tube 28 and into vacuum hose 29 Air is also drawn in through hole 9 through flexible drive sheath 7 and out through bearing 17 and into the shroud 14 thus producing a clean air flush for the flexible drive preventing the entry of abrasive drywall dust into the flexible drive and its bearings.

As has been indicated a suitable vacuum source must be provided recognizing the quantity and nature of the dust. A canister type vacuum cleaner with a collector bag (not shown) is connected to vacuum hose 29.

To ensure proper movement of the dust through the system it is desirable that the air velocity be maintained as uniform as possible with minimal eddy formation. Corners of the shroud are therefor curved as shown in FIG. 2 and the crossectional area of the air path is maintained as constant as possible. The gap around the edge of the periphery of the abrasive disc must also be maintained small to produce a high velocity for effective pickup of dust.

It will be seen that the pivot points of the sanding head 10 on legs 12 are further from the end of wand 4 than the center of the head where the flexible drive 5 and the vacuum line 27 enter the head. The forces imparted by the compressed vacuum line and the flexible drive tend to cause a clockwise rotation of the head on the pivots thus tending to cause the rear edge of the head to encounter the wall surface being sanded before the front edge. This will be found to facilitate proper operation of the sander.

Because the shroud is not attached to plate 13 but is free to slide up and down on legs 12 the location of the abrasive disc relative to the shroud is not fixed but depends on the force applied to plate 13 from the wand through legs 12. It is therefor possible for the operator to vary the pressure on the abrasive disc by varying the force he applies to the wand without necessarily distorting the bristles 26 and the shroud does not interfere with the application of pressure to the abrasive disc.

OPERATION

In operation the user places an abrasive disc on the drive plate 15, inserts the retainer disc 23 and the fastener 25 and forces the bayonets of the fastener down onto matching pins 30 on hub 22 ( see FIG. 4),thus locking the retainer disc down on the abrasive disc ensuring that it is firmly retained. The friction drive surface of drive plate 15 engages the foam backing 19 and provides a constant uniform drive for the abrasive disc. The user then presses switch 31 on the motor causing the motor to drive the flexible drive shaft 6 and drive plate 15 and places the sander against the wall. The couple produced by the location of legs 12 and the location of the compressed vacuum line 27 cause the rear edge of the sanding head to contact the wall first but as the user increases the pressure applied by the wand the front edge of the sanding head engages the wall, thus providing a gentle approach to the surface to minimize gouging and scratching of the surface of the paper. With increasing pressure the shroud is pushed back or the bristles are deflected and increasing pressure is applied to the abrasive disc. As the abrasive disc encounters the crown of the joint which is being sanded or other bumps or lumps of spackle the foam backing is compressed locally and, due to its non-linear compression characteristic, the pressure applied to the high points is substantially greater than the pressure applied to the surface of the paper. The quick memory of the foam however ensures that, as the disc leaves the high point the foam quickly returns to its original shape and uncompressed state.

If, at the same time as the user presses switch 31 he also activates the vacuum system, the air at the wall surface will be drawn under the shroud 14 through the vacuum line 27, down wand 4 and out through vacuum hose 29 and into the canister. Air will also be drawn in through hole 9, through flexible drive sheath 7 and through bearing 17 into the shroud.

Continued movement, in the normal sanding action will ensure that a smooth surface is produced with almost no free dust and, if the abrasive is properly selected, the surface will have a finish superior to that produced by hand sanding. The finish produced can closely match the texture of the paper surface of the drywall, thus resulting in a uniform appearance when the wall is painted, even with gloss or semigloss paint. Selection of the grit size of the abrasive will depend upon variables such as the nature of the spackle, desired smoothness and the time element. Such grit size may vary between 60 and 280 grit but for most applications sizes between 100 and 180 will be found most suitable. The transparent shroud allows the user to see how much dust is being removed thus providing a direct indication of the abrasive disc cut rate and vacuum performance and a guide of how quickly to progress in the sanding operation.

Thickness of the foam backing will normally lie between ⅜" and 1". Thickness less than ⅜" will not provide sufficient flexibility while thicknesses greater than 1" are waste-full and may exhibit undesirable response to drive energy.

Since the rear edge of the surface of the abrasive disc is primarily in contact with the wall, there is a tendency for the head to move sideways in response to the direction of rotation of the disc. This may be advantageous when working into corners and may cause the head to move into the corner and maintain light pressure against the adjacent wall. It is also convenient when sanding large surfaces. If the wand is held in a transverse position the frictional engagement of the abrasive disc with the wall surface will cause a lifting action on the sander counteracting gravity and reducing fatigue of the user.

It will also be evident that in working along the top edge of a wall adjacent the ceiling, the sander can be positioned in a manner such as to cause the head to gently contact the ceiling while sanding the wall portion adjacent the ceiling. If the clearance between the abrasive disc and the shroud is kept small to improve dust pick-up it will also provide maximum access to the corner surfaces leaving minimum areas to be hand sanded.

While other drive system may be possible, it appears that electric drive is most advantageous since it is relatively light, requires no auxiliary equipment and may provide variable speed. It has been found that a small universal motor, of fractional horsepower, such as is normally used for electric drills, is quite adequate to drive the sanding disc at sufficient speed to permit rapid sanding with acceptable finish.

While described with particular reference to drywall sanding it will be understood that the device may find application in other situations where large quantities of dust are produced in a sanding operation and the surfaces being sanded are relatively delicate.

A lamp such as lamp 33 which contains its own rechargable energy source or is powered from the motor power source may be found of particular advantage when working in poorly illuminated locations.

Because of the length of the wand 4 and the weights involved it may be found to be desirable to apply a coating or sleeve, such as sleeve 32 over the wand to provide a better grip for the user. A resilient rubbery material, such as an adhesive backed, vinyl, textured traction material may be found to add to the convenience of the user.

I claim:

1. A motorized sander comprising a sanding head pivotally mounted on one end of a tubular wand, a drive motor mounted on the other end of said wand, a flexible drive shaft coupled to said drive motor, said sanding head including a rotary drive plate coupled to said flexible drive shaft, a shroud surrounding the periphery of said drive plate, an abrasive disc mounted concentrically on said drive plate and driven by engagement of the contacting surfaces of said drive plate and said abrasive disc, and including a vacuum line connected from said shroud to said one end of said wand and a vacuum outlet connected to said wand intermediate its ends, said vacuum outlet being formed to receive a flexible vacuum hose.

2. A motorized sander as claimed in claim 1 wherein the edge of said shroud comprises a resilient material which engages the surface of the surface being sanded.

3. A motorized sander as claimed in claim 1 wherein said shroud is formed from a transparent material.

4. A motorized sander as claimed in claim 1 wherein the contacting surface of said drive plate is provided with a rough frictional drive surface.

5. A motorized sander as claimed in claim 1 wherein said abrasive disc comprises an annulus of open celled plastic foam flexibly coated with abrasive grit.

6. A motorized sander as claimed in claim 1 wherein said abrasive disc is mounted on said drive plate by means of a retainer disc and a quick release fastener.

7. A motorized sander as claimed in claim 1 wherein the pivotal mounting of said sanding head is further from said one end of said wand than the point of connection of said vacuum line to said shroud.

8. A motorized sander as claimed in claim 1 wherein said drive motor is a variable speed fractional horsepower electric motor.

9. A motorized sander comprising a sanding head pivotally mounted at one end of a hollow tubular wand, a motor having a rotating shaft mounted on the other end of said wand, a flexible drive arranged within said wand consisting of a flexible sheath and a flexible shaft supported within said sheath, said sanding head comprising a support plate, a shaft mounted in a bearing on said support plate, a circular drive plate mounted at its center on said shaft, said flexible shaft connecting said rotating shaft to said shaft mounted in said bearing, an annulus of flexible plastic foam bearing an abrasive coating concentrically mounted on said drive plate, a vacuum line extending from said one end of said wand and enclosing said flexible drive, a shroud surrounding said support plate and the periphery of said drive plate, said vacuum line terminating in said shroud and a vacuum outlet at a point intermediate the ends of said wand whereby a vacuum hose connected to said vacuum outlet will cause a flow of air from said shroud through said vacuum line, through said wand and out through said vacuum outlet.

10. A motorized sander as claimed in claim 9 wherein said annulus is formed from an open celled plastic foam bearing a flexible coating of abrasive.

11. A motorized sander as claimed in claim 10 wherein the surface of said drive plate contacting said foam is provided with a rough frictional drive surface.

12. A motorized sander as claimed in claim 11 wherein said rough frictional drive surface engages the open cells of said foam.

13. A motorized sander as claimed in claim 9 wherein said shroud is formed of a transparent plastic material.

14. A motorized sander as claimed in claim 9 wherein the edge of said shroud which engages the surface being sanded consists of bristles.

* * * * *